United States Patent [19]

Ponciano et al.

[11] 4,031,655

[45] June 28, 1977

[54] AERODYNAMIC SOUND-EMITTING AMUSEMENT DEVICE

[76] Inventors: Jose Ponciano, 1294 Southgate Ave., Daly City, Calif. 94015; Thomas S. Bautista, 1730 Silliman St., San Francisco, Calif. 94134

[22] Filed: Jan. 30, 1976

[21] Appl. No.: 653,817

[52] U.S. Cl. ..... 46/52; 46/74 D

[51] Int. Cl.[2] ..... A63H 33/18

[58] Field of Search ..... 46/52, 74 D, 175, 177

[56] References Cited

UNITED STATES PATENTS 3,359,678 12/1967 Headrick ..... 46/74 D 3,900,986 8/1975 Torres ..... 46/74 D

*Primary Examiner*—Russell R. Kinsey
*Assistant Examiner*—Robert F. Cutting
*Attorney, Agent, or Firm*—Townsend and Townsend

[57] ABSTRACT

An aerodynamic amusement device adapted to be thrown and sail through the air, emitting a sound while so sailing. The device is provided with a shallow, circular saucer-like body symmetrically located about a central axis. The body is provided a number of whistles located symmetrically about, and a predetermined distance from, the central axis. The device is adapted to be thrown so that it sails through the air, spinning about its central axis, and emitting a sound as it so sails.

8 Claims, 7 Drawing Figures

AERODYNAMIC SOUND-EMITTING AMUSEMENT DEVICE

This invention relates to amusement devices adapted to sail through the air and more particularly to such devices having sound-emitting structure located thereon.

BACKGROUND OF THE INVENTION

Present-day amusement devices which sail through the air, after being thrown, are generally circular and designed with aerodynamic principles in mind so that they sail with a spinning motion. One such device is illustrated in U.S. Pat. No. 3,359,678. When properly thrown, such devices remain airborne due to lifting forces exerted by the relative movement of air caused, in part, by the spinning action. These devices eventually settle to the ground, after being thrown, as the spinning action continues, providing amusement and delight to users.

Such amusement devices, as described, are for the most part, noise-free as they said through the air because of the desire to keep the structure thereof aerodynamically clean. If sound were to be emitted from such a device as it sails through the air and spins, it would add to the enjoyment of the user of the device. Recognizing this, there have been some attempts to provide such a device with sound-emitting structure. One known device with sound-emitting structure is described in U.S. Pat. No. 3,900,987. For the most part, however, many aerodynamic devices of the type to which this invention relates are manufactured and used without sound-emitting structure of any kind because of certain undesirable characteristics. For example, some whistle structures for aerodynamic devices are of such complex design that their cost of manufacture would seriously hamper the commercial aspects of the device. Further, other whistle structures proposed are heavy and bulky, thereby affecting and impairing the aerodynamic capabilities of the device. Finally, some known whistle structures for aerodynamic devices will operate only if the device is made to spin in one predetermined direction.

SUMMARY OF THE INVENTION

In order to overcome these deficiencies and increase the enjoyment obtained through the use of such aerodynamic devices, as described, there is provided according to the present invention, whistle structure mounted upon such devices to cause a sound to be emitted therefrom as it sails through the air. The sound is generated as a function of the spinning action and horizontal travel of the device. The device is a shallow saucer-shaped body having a central axis about which is a circular portion and an outer rim that circumscribes the circular portion. Symmetrically disposed upon the body, about the central axis, of the device is a whistle structure comprising a number of individual whistles that possess a simple, clean design and are lightweight to maintain the aerodynamic abilities of the device.

Each individual whistle has a bottom, side walls, and an apertured top portion which define an enclosure that functions basically as a resonant chamber of fixed size. Throwing the device with a motion to cause it to spin about its central axis, as it sails through the air, will generate an airstream about the device. The apertured top portions of each whistle are positioned so that the airstream blows across the aperture, partially into the whistle's chamber and partially away from it. The air entering the chamber causes a vibratory motion, which, in turn, produces a sound, the pitch of which is dependent upon the volume of the chamber. Thus, the whistle functions much as a simple tubular resonator with one end closed, the other end, through the aperture, open to the atmosphere thereby producing a whistling sound.

Two embodiments of whistles are disclosed. The first embodiment involves a whistle having a short tubular body with a closed, flat bottom and a hemispherical top containing the aperture. The whistles of this embodiment are located symmetrically on the circular portion a predetermined distance from the central axis of the device, adjacent the rim. The hemispherical top of the whistle is situated above the upper surface of the body. The aperture faces away from the central axis of the device, extending substantially from the apex of the top to the surface of the body of the device.

In an alternate embodiment, the whistle is generally cylindrical in shape, with one closed end and an opposite open end. A number of these whistles extend through the rim of the device with their longitudinal axis substantially perpendicular to the central axis of the device and with the open end positioned away therefrom.

The aperture of each whistle of either embodiment is positioned so as to be responsive to an air stream generated by the spinning action, as well as horizontal travel of, the device, as described. The body of the device can be of thin wall construction with an interior depth sufficient to sustain the lift of the device as it sails through the air. The device can be of one-piece construction and can be formed from a moldable, metallic, or other suitable material.

The primary object of this invention is to provide an aerodynamic amusement device of the type having a generally circular body adapted to be sailed with a spinning action through the air wherein the device has whistle structure located on its body for emitting a sound responsive to the spinning horizontal travel when thrown. Thus, the device adds measurably to the user's enjoyment thereof.

Another object of this invention is to provide a device of the type described having whistle structure comprising a number of spaced whistles mounted on an outer periphery of the device such that aerodynamic balance is maintained in order to allow the device to continuously spin as it sails through the air and until it settles to the ground.

Other objects of this invention will become apparent as the following specification progresses, reference being made to the accompanying drawings for an illustration of the invention.

IN THE DRAWINGS

DETAILED DESCRIPTION OF THE PREFERRED EMBODIMENT

Figure 5:
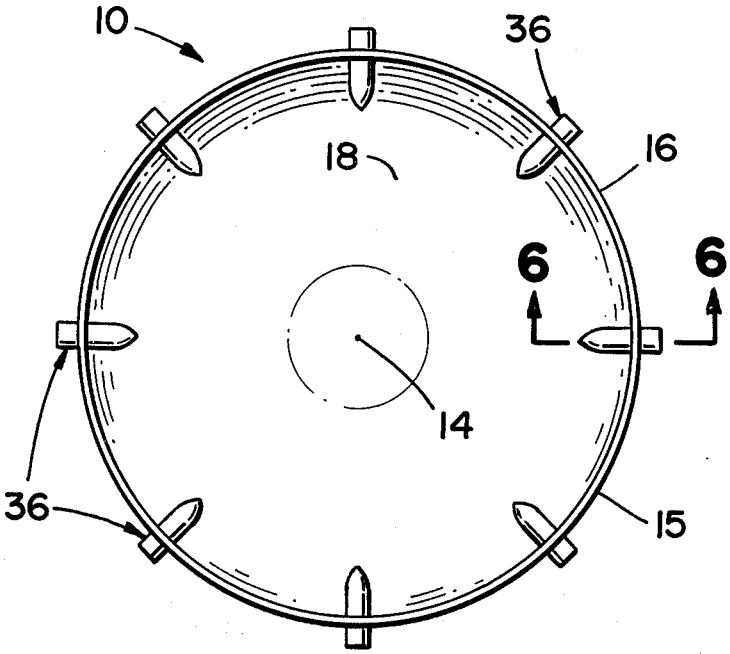
FIG. 5 is a bottom plan view of the device of this invention, showing an alternate embodiment of whistle structure positioned on the rim.

The aerodynamic amusement device of this invention is broadly denoted by the numeral 10 and includes a circular central portion 12 symmetrically situated about central axis 14 and, circumscribing the central portion, rim 16, which extends downward therefrom. The central portion has a slightly convex top surface 17 with a correspondingly concave bottom surface 18 (FIG. 5). The rim 16, which curves downward away from the central portion 12, in conjunction with the concave-convex shape of the central portion, form a generally circular, saucer-like shape. This saucer-like shape provides central portion 12 with sufficient lift in accordance with known aerodynamic principles so that it will remain in the air for a certain distance after being thrown, depending upon the initial velocity imparted to it and its initial height above ground.

The central portion 12 and rim 16 are preferably integral so that device 10 is of one-piece construction. It can be formed of plastic, metal, or other material permitting it to be sailed through the air.

Figure 3:
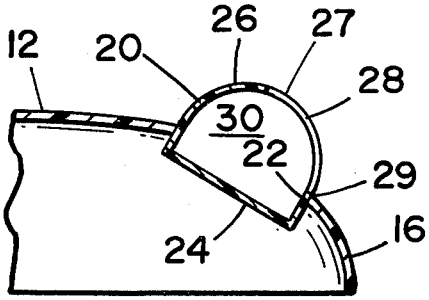
FIG. 3 is a cross sectional view taken along lines 3—3 of FIG. 1.
Figure 4:
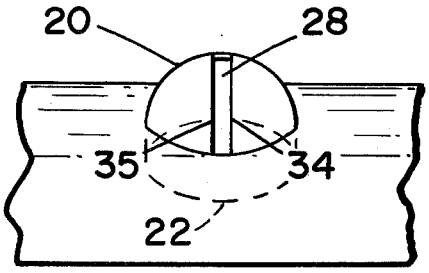
FIG. 4 is an enlarged partial side elevation illustrating a whistle of the preferred embodiment.

Included in device 10 is a whistle structure comprising whistles 20, symmetrically arranged to maintain the aerodynamic balance of the device. Referring specifically to FIG. 3, it can be seen that whistles 20 extend through central portion 12 with each whistle inluding a tubular wall portion 22, a bottom portion 24 and a hemispherical top portion 26 defining enclosed chamber 30. A generally rectangular aperture 28, located in top portion 22, communicated with chamber 30 of the whistle.

Figure 1:
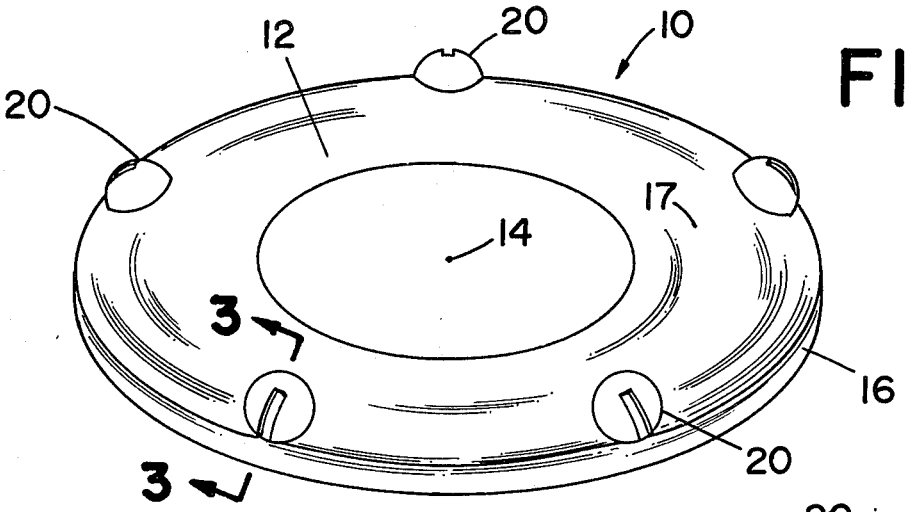
FIG. 1 is a perspective view of the aerodynamic amusement device of this invention, showing a whistle structure located on the body thereof.
Figure 2:
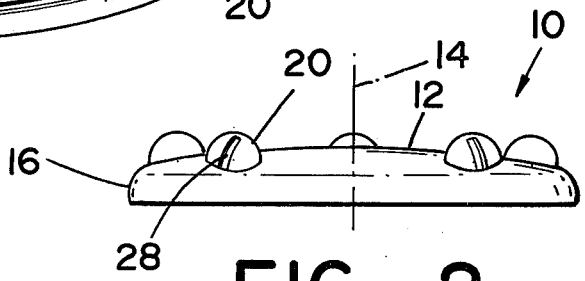
FIG. 2 is a side elevation of the device.

Each whistle 20 is positioned on device 10 so that hemispherical top portion 26 extends above top surface 17 of the device. Aperture 28, of each whistle, extends from apex 27 to junction 29 between device 10 and whistle 20 with the larger dimension of each aperture extending generally radially from central axis 14. Thus, each aperture is positioned to face directly away from the central axis 14 of the device. So disposed, the aperture 28 of each whistle 20 is positioned so that airflow across the aperture will be divided by edge 34 or edge 35, depending upon the direction of spin (FIG. 2), thereby causing a portion of the airflow to enter closed chamber 30. Closed chamber 30 then acts as a resonant chamber creating a vibratory motion and causing whistle 20 to function as a tubular resonator to produce a sound.

Whistles 20 may also be formed of plastic, metal or the like and may be constructed separately and later mounted on device 10 by conventional means. Alternatively, whistles 20 may also be made integral with central portion 12.

Figure 6:
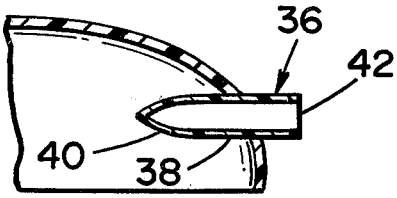
FIG. 6 is a cross sectional view of a whistle of the alternate embodiment, taken along lines 6—6 of FIG. 5.
Figure 7:
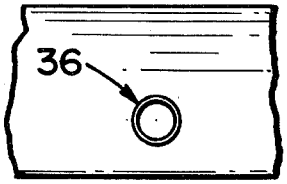
FIG. 7 is an enlarged partial side elevation illustrating a whistle of the alternate embodiment.

An alternate embodiment of the whistle structure is shown in FIGS. 5–7. The whistle therein consists of whistles 36 which include a tube 38 having a closed bottom 40 and an opposite open end 42. Whistles 36 are situated to pierce rim 16 and extend therethrough. The longitudinal of each whistle extends radially of central axis 14 with the open 42 extending away therefrom and beyond outer rim surface 15 of rim 16. As described above, the spinning action of the device 10, as it sails through the air, creates an air stream across open end 42 of each whistle 36. A portion of the air will enter each whistle. This method of excitation causes each whistle 36 to also function much as a simple tubular resonator.

In operation, device 10 is thrown so that the plane of central portion 12 remains substantially horizontal with rim 16 extending downward. The device is given an initial spin, either clockwise or counterclockwise, as it is thrown so that the device will continue to spin about axis 14 as it sails through the air.

During the time in which the device is in the air and is spinning, an air stream movement will be continuously developed across the apertures 28 or 42 of the respective whistles 20 or 36. A portion of the air stream will enter the chambers of the whistles wherein a vibratory motion of the air stream produces sound. The volume of the resonant chamber of each respective whistle will determine the pitch of the sound. The whistling sound emitted by each whistle 20 (or 36 of the alternate embodiment), will continue so long as device 10 spins about axis 14 and continues its horizontal flight.

While the aerodynamic amusement device 10 has been described with respect to particular embodiments of the whistle structure, it is possible that the device have mounted thereon other types of whistle structure without going beyond the spirit and scope of the present invention. For example, whistles 20 may be open at both ends such that a simple tubular resonator with both ends open to the atmosphere is created. Moreover, whistles 20 or 36 can be mounted on the outer periphery of the device in any suitable manner provided the body is dynamically balanced. Although the foregoing invention has been described in some detail by way of illustration and example for purposes of clarity of understanding, it should be obvious that such changes and modifications may be practiced within the scope of the invention. Accordingly, the intent is to embrace all such changes, modifications, and variations as fall within the spirit and broad scope of the appended claims.

We claim:

1. An aerodynamic amusement device, comprising:

a circular body provided with an outer surface, a central portion, a central axis, and a rim circumscribing the central portion and curving downward therefrom, said body adapted to be thrown and to sail through the air after being thrown and to spin about the central axis as the body sails through the air; and a plurality of whistle means for producing a sound symmetrically positioned upon the body a predetermined distance from the central axis, each whistle means having a chamber defined by side walls symmetrically arranged about a chamber axis that is positioned substantially normal to the body surface, a closed end and an opposite end portion forming a single aperture that communicates with the chamber, the aperture being positioned with respect to and above the outer surface of the body to allow air to pass across the aperture as the device sails through the air spinning about its central axis after being thrown.

2. The aerodynamic amusement device of claim 1, wherein the opposite end portion includes a positively curved top having at least one axis of symmetry aligned with the chamber axis, the aperture defining a pair of opposed edges extending longitudinally along a direction normal to the axis of symmetry along the curved top.

3. The aerodynamic amusement device of claim 2, wherein the aperture extends generally along a radius of the body.

4. A sound-emitting aerodynamic amusement device comprising:

a body having a central axis, a circular portion symmetrically located about the central axis, a peripheral portion bounding the circular portion and curving downward therefrom thereby forming an upper generally convex surface and a lower generally concave surface; and a plurality of whistle means symmetrically located on the body a predetermined distance from the central axis for producing a sound, each whistle means provided with an enclosure defined by a closed bottom end, side walls, and a top end having portions defining a single elongate aperture that communicates with the enclosure, the aperture including a pair of opposed edges positioned with respect to the upper surface of the body to have an air stream pass across the aperture, normal to the aperture edges, as the device sails through the air, spinning about its central axis, such that the air stream is generated by said sailing and spinning thereby causing each whistle means to produce a sound.

5. The amusement device of claim 4, wherein each whistle means is positioned on the circular portion adjacent the peripheral portion.

6. The amusement device of claim 5, wherein each top end of each whistle means has a semispherical shape with an axis of symmetry substantially normal to the upper surface.

7. The amusement device of claim 6, wherein the slot extends along the top end from an apex thereof to the upper surface of the body.

8. The amusement device of claim 7, wherein the side walls of each whistle means define a cylinder.

* * * * *